US005609818A

United States Patent [19]

Kato et al.

[11] Patent Number: 5,609,818

[45] Date of Patent: Mar. 11, 1997

[54] STEEL EXCELLENT IN CORROSION RESISTANCE AND PROCESSABILITY

[75] Inventors: Kenji Kato; Akihiro Miyasaka, both of Aichi-ken, Japan

[73] Assignee: Nippon Steel Corporation, Tokyo, Japan

[21] Appl. No.: 448,592

[22] PCT Filed: Dec. 9, 1993

[86] PCT No.: PCT/JP93/01790

§ 371 Date: Jun. 6, 1995

§ 102(e) Date: Jun. 6, 1995

[87] PCT Pub. No.: WO94/13848

PCT Pub. Date: Jun. 23, 1994

[30] Foreign Application Priority Data

| | | | |
|---|---|---|---|
| Dec. 11, 1992 | [JP] | Japan | 4-331652 |
| Dec. 11, 1992 | [JP] | Japan | 4-331653 |
| Dec. 11, 1992 | [JP] | Japan | 4-331654 |

[51] Int. Cl.[6] ..... C22C 38/06

[52] U.S. Cl. ..... 420/62; 420/103; 420/104

[58] Field of Search ..... 420/103, 104, 420/110, 111, 62, 63

[56] References Cited

FOREIGN PATENT DOCUMENTS

| | | | |
|---|---|---|---|
| 664462 | 6/1963 | Canada | 420/103 |
| 56-150159 | 11/1981 | Japan | 420/63 |

*Primary Examiner*—Deborah Yee
*Attorney, Agent, or Firm*—Wenderoth, Lind & Ponack

[57] ABSTRACT

This invention relates to a steel excellent in corrosion resistance and processability, and more particularly to a steel excellent in corrosion resistance for the exhaust system of an internal combustion engine of, for example, an automobile or ship. Such steel contains not less than 0.01% and less than 1.2% of Si, 0.1–1.5% of Mn, 5.5–9.9% of Cr and 0.3–3.0% of Al, is reduced to a content of C of not more than 0.02%, P of not more than 0.03%, S of not more than 0.01% and N of not more than 0.02%, contains Nb, V, Ti, Zr, Ta and Hf in a total amount of 0.01–0.5%, satisfies the relationship set out below, and optionally contains in addition one or more of Cu, Mo, Sb, Ni, W, rare earth elements, and Ca, the remainder being Fe and unavoidable impurities.

$$(Nb/93)+(V/51)+(Ti/48)+(Zr/91)+(Ta/181)+(Hf/179)-0.8\times[(C/12)+(N/14)]\geqq 0$$

8 Claims, No Drawings

STEEL EXCELLENT IN CORROSION RESISTANCE AND PROCESSABILITY

TECHNICAL FIELD

This invention relates to a steel that is excellent in corrosion resistance and processability and more particularly to a steel that exhibits excellent corrosion resistance in the exhaust system of an internal combustion engine such as of an automobile, ship or the like and which also exhibits excellent processability during processing into components.

BACKGROUND ART

In the exhaust systems of internal combustion engines, particularly those used in automobiles, corrosion from the internal and external surfaces has conventionally been suppressed by the use of ordinary steel plated with aluminum or zinc. However, since exhaust systems are now equipped with catalytic converters or the like for purifying the exhaust gas to reduce environmental pollution, the corrosion resistance provided by such plated steels has become inadequate. As taught, for example, by Japanese Patent Public Disclosures No. Sho 63-143240 and 63-143241, therefore, steels containing 5–10% of Cr were developed for increasing the corrosion resistance of the steel base material. In response to recent increases in the service life and warranty period of automobiles, however, large amounts of high-grade stainless steels containing around 18% of Cr, with or without addition of Mo, are now being used in exhaust systems. Even such high-grade stainless steels have been found to be insufficient in corrosion resistance and subject to localized corrosion (pitting) and the like. Moreover, since the large amounts of Cr and Mo contained in such high-grade stainless steels degrades their processability, they are extremely difficult to fabricate into complexly shaped components such as those used in exhaust systems, and the highly complicated manufacturing processes required increases the processing cost. They may even be completely unusable for some shapes and, at any rate, are expensive as a raw material.

When a steel with a given Cr content becomes more susceptible to pitting owing to a more severe operating environment, as is typical in exhaust systems, the problem is generally coped with by further increasing the Cr or Mo content so as to strengthen the resistance to corrosion.

In light of these circumstances, the object of the present invention is to provide a steel which exhibits strong resistance to a corrosive environment such as present in the exhaust system of an internal combustion engine, exhibits excellent processability, and is low in cost.

DISCLOSURE OF THE INVENTION

For achieving this object, the inventors conducted studies from various points of view in order to develop a steel with excellent corrosion resistance in corrosive environments, particularly in the corrosive environment of an exhaust system. Beginning their studies with the corrosive environment of exhaust systems, they discovered that corrosion of an internal combustion engine exhaust system occurs in an environment of chloride ions, sulfate ions and the like heated to 80°–150° C. They next examined various means for increasing corrosion resistance in such a corrosive environment and discovered that, exactly opposite from in prior art stainless steels, a steel with a reduced Cr content of 5.5–9.9% and added with 1.0–3.0% of Al exhibits extraordinarily good corrosion resistance in exhaust systems and other such corrosive environments. Additional studies directed to providing a further improved steel revealed that when the foregoing steel is reduced in C and N content and added with Nb, V, Ti, Zr, Ta and Hf to meet a prescribed condition, its corrosion resistance is increased and its processability improved, that when the foregoing steel is added with Cu, Mo, Sb, Ni and W, independently or in combination, its corrosion resistance is improved, and that Si and Mn are suitable deoxidation and strengthening elements for the steel.

The present invention was accomplished on the basis of the foregoing knowledge. In its first aspect, the invention resides in a steel excellent in corrosion resistance and processability which, in weight per cent, contains not less than 0.01% and less than 1.2% of Si, 0.1–1.5% of Mn, 5.5–9.9% of Cr and 1.0–3.0% of Al, is reduced to a content of C of not more than 0.02%, P of not more than 0.03%, S of not more than 0.01% and N of not more than 0.02%, contains one or more elements selected from among Nb, V, Ti, Zr, Ta and Hf in a total amount of 0.01–0.5%, and satisfies the relationship $$(Nb/93)+(V/51)+(Ti/48)+(Zr/91)+(Ta/181)+(Hf/179)-0.8\times[(C/12)+(N/14)]\geqq 0,$$

the remainder being Fe and unavoidable impurities.

In its second aspect, the invention resides in a steel which as addition components to those of the steel according to the first aspect of the invention contains, in weight per cent, one or more of 0.05–3.0% of Cu, 0.05–2.0% of Mo, 0.01–0.5% of Sb, 0.01–2.0% of Ni and 0.05–3.0% of W.

In its third aspect, the invention resides in a steel which as addition components to those of the steel according to the first aspect of the invention contains, in weight per cent, one or more of 0.001–0.1% of rare earth elements and 0.0005–0.03% of Ca.

In its fourth aspect, the invention resides in a steel which as addition components to those of the steel according to the second aspect of the invention contains, in weight per cent, one or more of 0.001–0.1% of rare earth elements and 0.0005–0.03% of Ca.

BEST MODE FOR CARRYING OUT THE INVENTION

The reason for the limitation of the content ranges of the individual Components in the invention will be described in the following.

Si: In a steel containing 5.5% or more of Cr, added Si is effective as a deoxidizing agent and strengthening element. However, it does not manifest a sufficient deoxidizing effect when present at a content of less than 0.01% and, when present at 1.2% or more, not only experiences a saturation of effect but also degrades processability. The content range thereof is therefore limited to not less than 0.01% and less than 1.2%.

Mn: Mn is necessary as a deoxidizing agent for the steel and is required to be present at a content of not less than 0.1%. When contained in excess of 1.5%, however, not only does Mn experience a saturation of effect but the excessive Mn content degrades processability. Its upper content limit is therefore set at 1.5%.

Cr: Cr must be added to a content of at least 5.5% for securing corrosion resistance but when added to a content exceeding 9.9% not only unnecessarily increases cost but also degrades processability. Its upper content limit is therefore set at 9.9%.

Al: Like Cr, Al is an important element in this invention for securing corrosion resistance. As pointed out earlier, Al does not sufficiently suppress pitting at a content of less than 1.0% and, on the other hand, experiences a saturation of effect and degrades processability when added in excess of 3.0%. The content range of Al is therefore limited to 1.0–3.0%.

C, N: C and N degrade the processability of the steel sheet and, in addition, C degrades corrosion resistance by forming a carbide with Cr while N degrades toughness. Since low contents of C and N are therefore desirable, the upper content limit of both is set at 0.02% and the lowest possible content of both is preferable.

P: A low content of P is preferable because it degrades toughness when present in a large amount. The upper content limit thereof is therefore set at 0.03%.

S: A low content of S is preferable because it degrades pitting resistance when present in a large amount. The upper content limit thereof therefore is set at 0.01%.

Nb, V, Ti, Zr, Ta, Hf: By fixing the C and N in a high Cr steel as carbides and nitrides, Nb, V, Ti, Zr, Ta and Hf manifest a pronounced effect toward increasing corrosion resistance and improving processability. Although they can be added individually or in combinations of two or more, they have no effect when added either individually or in combination to a total amount of less than 0.01%, while when added in excess of 0.5% they not only unnecessarily increases cost but also become a cause of roll marks. The upper content limit is therefore set at 0.5%. For effectively improving processability, moreover, the amount of added Nb, V, Ti, Zr, Ta, and Hf must satisfy the relationship $$(Nb/93)+(V/51)+(Ti/48)+(Zr/91)+(Ta/181)+(Hf/179)-0.8\times[(C/12)+(N/14)]\geqq 0.$$

While the basic components of the steel excellent in corrosion resistance and processability aimed at by the present invention are as set out in the foregoing, the invention is also directed to a steel whose properties are further improved by additionally containing as required, the elements set out below.

Cu: When added at not less than 0.05% to a steel containing not less than 5.5% of Cr and not less than 1.0% of Al, Cu has an effect of increasing resistance to total surface corrosion. When added in excess of 3.0%, however, it not only experiences a saturation of effect but also degrades hot workability. Its upper content limit is therefore set at 3.0%.

Mo: When added at not less than 0.05% to a steel containing not less than 5.5% of Cr and not less than 0.3% of Al, Mo has an effect of suppressing the occurrence and growth of pits. When added in excess of 2.0%, however, it not only experiences a saturation of effect but also degrades processability. Its upper content limit is therefore set at 2.0%.

Sb: When added at not less than 0.01% to a steel containing not less than 5.5% of Cr and not less than 1.0% of Al, Sb has an effect of improving resistance to pitting and total surface corrosion. When added in excess of 0.5%, however, it degrades workability. Its upper content limit is therefore set at 0.5%.

Ni: When added at not less than 0.01% to a steel containing not less than 5.5% of Cr and not less than 1.0% of Al, Ni has an effect of suppressing pitting. When added in excess of 2.0%, however, it not only experiences a saturation of effect but also degrades hot workability. Its upper content limit is therefore set at 2.0%.

W: When added at not less than 0.05% to a steel containing not less than 5.5% of Cr and not less than 1.0% of Al, W has a pronounced effect of suppressing the occurrence and growth of pits. When added in excess of 3.0%, however, it not only experiences a saturation of effect but also degrades processability. Its upper content limit is therefore set at 3.0%.

Rare earth elements (REM), Ca: Rare earth elements and Ca are elements having an effect of increasing hot workability and improving pitting resistance. Sufficient effect is not manifested at an addition amount of rare earth elements of less than 0.001% or of Ca of less than 0.0005%, while addition of rare earth elements in excess of 0.1% or of Ca in excess of 0.03% has the adverse effects of degrading hot workability, owing to the formation of coarse nonmetallic inclusions, and degrading pitting resistance. The upper content limit of rare earth elements is therefore set at 0.1% and that of Ca at 0.03%. In this invention "rare earth elements" means the elements with atomic numbers 57–71 and 89–103 and Y.

When the steel proposed by the present invention is used in the exhaust system of an internal combustion engine, it is first produced as a steel sheet which can thereafter be formed into a prescribe shape using a press or the like and then fabricated into a product by processing and welding. Alternatively, the steel sheet can be first formed into a tube such as an electric welded steel tube and subject to secondary processing and welding for use as the product. All steels having the composition and combination of elements defined by the present invention, whether processed by these or other processes, are subjects of the invention. The optimum production processes can be selected in light of cost, limitations of existing production facilities and the like, and no selection of a process results in a deviation from the invention. In addition, the steel proposed by the invention can be applied not only to internal combustion engine exhaust systems but also to various other corrosive environments such as environments in which it is exposed to high-temperature aqueous solutions containing chloride ions, sulfate ions and the like or in which heating and cooling occur repeatedly.

EXAMPLES

Examples of the invention will now be explained.

Steels of the compositions shown in Tables 1–8 were formed into steel sheets of a thickness of 1 mm by ordinary steel sheet production processes including melting, hot rolling, cold rolling and the like, and were then annealed at 850° C. A test specimen measuring 50 mm in width and 70 mm in length was cut from each sheet and subjected to a corrosion test. The test was carried out by repeating twenty times the process of immersing one half of the specimen in 50 $cm^3$ of an aqueous solution added with 100 ppm of sulfate ions, 100 ppm of chloride ions and 500 ppm of bicarbonate ions in the form of ammonium salt, maintaining the atmosphere of the vessel at 130° C. and completely evaporating and volatilizing the test solution. This was for simulating the corrosive condition of an automobile exhaust system. The results of the corrosion test are shown in Tables 2, 4, 6 and 8. In the corrosion test results of Tables 2, 4, 6 and 8, ⊚ indicates a maximum corrosion depth of not more than 0.15 mm, O a maximum corrosion depth of not more than 0.2 mm, and X a maximum corrosion depth exceeding 0.2 mm. Processability was evaluated by conducting a cup test at a reduction ratio of 1.8 and checking for occurrence of cracking. These test results are also shown in Tables 2, 4, 6 and 8. O indicates good results in the cup test and X indicates that cracking occurred in the cup test.

As is clear from Tables 1–8, the invention steels Nos. 1–17, 19–37 and Nos. 50, 52–57, 59, 61, 65, 67, 69, 71, 72, 75 and 77–86 exhibited good corrosion resistance even in an extremely harsh corrosive environment (exhaust environment) and were also excellent in processability, while the comparison steels Nos. 38–49 and Nos. 87–98 were inferior in both corrosion resistance and processability.

TABLE 1

| No. | Composition (Wt %) | | | | | | | | | | | |
|---|---|---|---|---|---|---|---|---|---|---|---|---|
| | C | Si | Mn | P | S | Al | Cr | Nb | V | Ti | Zr | Ta |
| | | | | | INVENTION STEELS | | | | | | | |
| 1 | 0.006 | 0.90 | 0.25 | 0.026 | 0.003 | 1.47 | 5.8 | 0.10 | | | | |
| 2 | 0.007 | 0.47 | 1.02 | 0.026 | 0.005 | 1.53 | 6.8 | | 0.05 | | | |
| 3 | 0.004 | 0.63 | 1.14 | 0.027 | 0.006 | 1.62 | 9.8 | | | 0.035 | | |
| 4 | 0.008 | 0.24 | 0.58 | 0.022 | 0.009 | 2.56 | 5.7 | | | | 0.14 | |
| 5 | 0.005 | 0.11 | 0.80 | 0.022 | 0.006 | 2.91 | 9.2 | | | | | 0.16 |
| 6 | 0.003 | 0.19 | 0.50 | 0.022 | 0.008 | 2.13 | 8.9 | | | | | |
| 7 | 0.006 | 0.52 | 0.45 | 0.021 | 0.006 | 1.55 | 8.1 | | | 0.104 | | |
| 8 | 0.005 | 0.53 | 0.71 | 0.027 | 0.006 | 1.39 | 8.0 | 0.08 | | | | |
| 9 | 0.005 | 0.69 | 1.10 | 0.021 | 0.004 | 1.41 | 7.8 | | 0.04 | | | |
| 10 | 0.009 | 0.32 | 0.68 | 0.022 | 0.004 | 1.44 | 7.5 | | | | 0.12 | |
| 11 | 0.005 | 0.95 | 0.80 | 0.024 | 0.007 | 1.42 | 8.1 | | 0.01 | | | 0.15 |
| 12 | 0.006 | 0.12 | 0.77 | 0.020 | 0.004 | 1.61 | 7.7 | 0.08 | | 0.107 | 1 | |
| 13 | 0.005 | 0.45 | 0.61 | 0.026 | 0.005 | 1.22 | 7.4 | | | 0.042 | 0.01 | |
| 14 | 0.007 | 0.71 | 0.60 | 0.019 | 0.006 | 1.49 | 9.1 | | | | | |
| 15 | 0.005 | 0.74 | 0.63 | 0.023 | 0.005 | 1.68 | 9.3 | 0.12 | | | | |
| 16 | 0.006 | 1.05 | 0.47 | 0.025 | 0.004 | 1.48 | 8.3 | | 0.11 | | | |
| 17 | 0.006 | 0.76 | 0.88 | 0.019 | 0.008 | 1.51 | 8.2 | | 0.05 | | | |
| 19 | 0.003 | 0.73 | 1.07 | 0.024 | 0.007 | 2.11 | 9.1 | | | | 0.07 | |
| 20 | 0.009 | 0.58 | 1.12 | 0.026 | 0.005 | 1.84 | 8.5 | 0.32 | 0.03 | | | |
| 21 | 0.011 | 0.36 | 0.80 | 0.025 | 0.005 | 2.69 | 6.8 | | | 0.081 | | |
| 22 | 0.003 | 0.95 | 0.71 | 0.020 | 0.006 | 2.55 | 7.7 | | | 0.108 | 0.05 | |
| 23 | 0.018 | 0.87 | 0.50 | 0.020 | 0.005 | 2.75 | 7.9 | 0.05 | 0.03 | 0.107 | | |
| 24 | 0.003 | 0.41 | 0.31 | 0.023 | 0.006 | 2.11 | 8.1 | 0.18 | | | | |
| 25 | 0.003 | 0.20 | 1.25 | 0.025 | 0.004 | 2.31 | 7.7 | 0.06 | | 0.025 | | |

TABLE 2

| No. | Composition (Wt %) | | | | | | | | X value | Processability | Max. corrosion depth |
|---|---|---|---|---|---|---|---|---|---|---|---|
| | Hf | Cu | Mo | Sb | Ni | Ca | REM | N | ×1000 | | |
| | | | | | INVENTION STEELS | | | | | | |
| 1 | | | | | | | | 0.009 | 1.6 | ○ | ○ |
| 2 | | | | | | | | 0.005 | 2.3 | ○ | ○ |
| 3 | | | | | | | | 0.006 | 1.2 | ○ | ○ |
| 4 | | | | | | | | 0.012 | 3.2 | ○ | ◎ |
| 5 | | | | | | | | 0.008 | 0.9 | ○ | ◎ |
| 6 | 0.15 | | | | | | | 0.009 | 1.2 | ○ | ◎ |
| 7 | | 1.2 | | | | | | 0.007 | 13.8 | ○ | ○ |
| 8 | | | 1.5 | | | | | 0.006 | 1.8 | ○ | ○ |
| 9 | | | | 0.21 | | | | 0.007 | 0.5 | ○ | ○ |
| 10 | | | | | 1.8 | | | 0.006 | 3.8 | ○ | ○ |
| 11 | | | | | | 0.008 | | 0.009 | 1.8 | ○ | ○ |
| 12 | | | | | | | 0.015 | 0.011 | 20.6 | ○ | ○ |
| 13 | | 1.3 | 1.2 | | | | | 0.008 | 1.7 | ○ | ○ |
| 14 | 0.18 | 1.1 | | 0.06 | | | | 0.009 | 0.2 | ○ | ○ |
| 15 | | 1.0 | | | 0.9 | | | 0.008 | 5.0 | ○ | ◎ |
| 16 | | 1.1 | | | | 0.010 | | 0.009 | 12.4 | ○ | ○ |
| 17 | | 1.1 | | | | | 0.013 | 0.009 | 0.7 | ○ | ○ |
| 19 | | | 1.2 | | 0.8 | | | 0.008 | 1.1 | ○ | ◎ |
| 20 | | | 1.0 | | | 0.009 | | 0.009 | 29.1 | ○ | ◎ |
| 21 | | | 0.9 | | | | 0.011 | 0.008 | 5.0 | ○ | ◎ |
| 22 | | | | 0.05 | 0.9 | | | 0.010 | 19.8 | ○ | ◎ |
| 23 | | | | 0.07 | | 0.011 | | 0.008 | 17.0 | ○ | ◎ |
| 24 | | | | 0.06 | | | 0.055 | 0.009 | 12.2 | ○ | ◎ |
| 25 | | | | | 1.1 | 0.009 | | 0.015 | 1.0 | ○ | ◎ |

(continued from Table 1, Part-1)

The X values in the Table are the value obtained by calculation from the following expression.

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

TABLE 3

| No. | Composition (Wt %) C | Si | Mn | P | S | Al | Cr | Nb | V | Ti | Zr | Ta |
|---|---|---|---|---|---|---|---|---|---|---|---|---|
| | | | | | INVENTION STEELS | | | | | | | |
| 26 | 0.018 | 0.18 | 0.71 | 0.026 | 0.006 | 2.89 | 7.6 | 0.11 | | 0.113 | | |
| 27 | 0.003 | 0.15 | 0.30 | 0.025 | 0.004 | 2.13 | 8.2 | | 0.14 | | | |
| 28 | 0.003 | 0.97 | 0.59 | 0.021 | 0.005 | 2.15 | 9.1 | | 0.02 | 0.025 | | |
| 29 | 0.018 | 0.86 | 0.82 | 0.020 | 0.007 | 2.86 | 7.7 | 0,12 | | 0.097 | | |
| 30 | 0.003 | 1.00 | 0.89 | 0.025 | 0.005 | 2.77 | 7.3 | 0,22 | | | | |
| 31 | 0.003 | 0.51 | 0.47 | 0.018 | 0.004 | 2.31 | 5.9 | | | 0.150 | | |
| 32 | 0.018 | 0.37 | 0.93 | 0.020 | 0.006 | 2.99 | 8.1 | 0.05 | 0.04 | 0.045 | | |
| 33 | 0.003 | 0.92 | 0.57 | 0.022 | 0.004 | 2.99 | 8.3 | 0.08 | 0.03 | | | |
| 34 | 0.018 | 0.55 | 0.43 | 0.018 | 0.006 | 2.51 | 7.3 | | | 0.070 | 0.11 | |
| 35 | 0.003 | 0.69 | 0.85 | 0.024 | 0.004 | 2.35 | 8.8 | | | 0.136 | | |
| 36 | 0.003 | 0.29 | 0.76 | 0.023 | 0.005 | 2.34 | 6.7 | | | 0.110 | | 0.12 |
| 37 | 0.018 | 0.32 | 0.88 | 0.019 | 0.005 | 2.89 | 7.3 | | 0.03 | 0.035 | | |
| | | | | | COMPARISON STEELS | | | | | | | |
| 38 | 0.005 | 0.48 | 0.39 | 0.019 | 0.004 | 0.05 | 2.3 | | | 0.110 | | |
| 39 | 0.008 | 0.17 | 0.85 | 0.019 | 0.005 | 0.29 | 7.3 | 0.03 | | | | |
| 40 | 0.007 | 0.26 | 0.46 | 0.025 | 0.006 | 0.27 | 7.5 | | | | 0.22 | |
| 41 | 0.047 | 0.82 | 0.13 | 0.023 | 0.006 | 0.22 | 9.3 | | | | | 0.02 |
| 42 | 0.061 | 0.24 | 0.35 | 0.028 | 0.006 | 0.04 | 5.2 | | | | | |
| 43 | 0.012 | 0.12 | 0.22 | 0.026 | 0.004 | 0.28 | 9.8 | | | | | |
| 44 | 0.018 | 0.20 | 0.47 | 0.027 | 0.004 | 0.03 | 9.3 | | | | | |
| 45 | 0.015 | 0.33 | 1.04 | 0.019 | 0.003 | 0.04 | 8.6 | | | 0.010 | | |
| 46 | 0.045 | 0.76 | 1.04 | 0.027 | 0.005 | 0.03 | 9.2 | | | | | |
| 47 | 0.028 | 0.41 | 0.71 | 0.025 | 0.005 | 0.03 | 9.1 | 0.02 | | | 0.01 | |
| 48 | 0.028 | 0.63 | 0.76 | 0.018 | 0.007 | 0.03 | 11.5 | | | 0.009 | | |
| 49 | 0.012 | 1.40 | 0.71 | 0.026 | 0.006 | 0.05 | 10.8 | 0.15 | 0.05 | 0.050 | | |

(continued from Table 1, Part-2)

TABLE 4

| No. | Composition (Wt %) Hf | Cu | Mo | Sb | Wi | Ca | REM | N | X value '10000 | Processability | Max. corrosion depth |
|---|---|---|---|---|---|---|---|---|---|---|---|
| | | | | | INVENTION STEELS | | | | | | |
| 26 | | | | | 1.3 | | 0.062 | 0.008 | 18.8 | ○ | ◎ |
| 27 | | | | | | 0.008 | 0.082 | 0.008 | 20.7 | ○ | ◎ |
| 28 | | 1.0 | 1.2 | 0.08 | | | | 0.010 | 1.2 | ○ | ◎ |
| 29 | | 1.1 | 1.1 | | 1.1 | | | 0.013 | 13.5 | ○ | ◎ |
| 30 | | 1.0 | 1.3 | | | 0.008 | | 0.010 | 15.9 | ○ | ◎ |
| 31 | | 1.1 | 1.2 | | | | 0.005 | 0.013 | 21.6 | ○ | ◎ |
| 32 | | 0.3 | 0.8 | 0.05 | 1.2 | | | 0.016 | 1.2 | ○ | ◎ |
| 33 | | 0.8 | 0.7 | 0.09 | | 0.009 | | 0.017 | 2.8 | ○ | ◎ |
| 34 | | 1.2 | 1.5 | 0.05 | | | 0.066 | 0.013 | 7.4 | ○ | ◎ |
| 35 | | 0.8 | 0.7 | 0.03 | 0.8 | 0.003 | | 0.009 | 21.1 | ○ | ◎ |
| 36 | | 0.9 | 0.6 | 0.04 | 1.0 | | 0.072 | 0.010 | 21.7 | ○ | ◎ |
| 37 | 0.15 | 1.1 | 0.9 | 0.08 | 0.5 | 0.09 | 0.088 | 0.010 | 3.8 | ○ | ◎ |
| | | | | | COMPARISON STEELS | | | | | | |
| 38 | | | | | | | | 0.011 | 13.5 | ○ | X |
| 39 | | | | | | | | 0.014 | −10.3 | X | X |
| 40 | | | | | | | | 0.014 | 11.2 | ○ | X |
| 41 | | | | | | | | 0.11 | −36.5 | X | X |
| 42 | 0.02 | | | | | | 0.032 | 0.006 | −43.0 | X | X |
| 43 | | | | | | 0.003 | | 0.008 | −12.6 | X | X |
| 44 | | | 1.5 | | | | | 0.007 | −16.0 | X | X |
| 45 | | | | 0.41 | | | | 0.008 | −12.5 | X | X |
| 46 | | 1.1 | | | | | | 0.009 | −35.1 | X | X |
| 47 | | | | | 1.8 | | | 0.007 | −19.4 | X | X |
| 48 | 0.01 | 0.1 | | | | | | 0.009 | −21.4 | X | X |
| 49 | | 0.4 | | | | | | 0.012 | 21.5 | ○ | X |

(continued from Table 1, Part-3)

The X values in the Table are the value obtanined by calculation from the following expression.

TABLE 4-continued

| No. | Composition (Wt %) Hf | Cu | Mo | Sb | Wi | Ca | REM | N | X value '10000 | Processability | Max. corrosion depth |
|---|---|---|---|---|---|---|---|---|---|---|---|
| $\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$ | | | | | | | | | | | |

10

TABLE 5

| No. | Composition (Wt %) C | Si | Mn | P | S | Al | Cr | W | Nb | V | Ti | Zr |
|---|---|---|---|---|---|---|---|---|---|---|---|---|
| | | | | | INVENTION STEELS | | | | | | | |
| 50 | 0.016 | 0.33 | 0.94 | 0.010 | 0.009 | 1.55 | 6.3 | 2.59 | 0.18 | | | |
| 52 | 0.007 | 0.39 | 0.80 | 0.013 | 0.007 | 0.77 | 6.5 | 2.22 | | | | 0.18 |
| 53 | 0.018 | 0.18 | 0.22 | 0.020 | 0.007 | 1.11 | 7.6 | 1.48 | | | | |
| 54 | 0.015 | 0.68 | 1.47 | 0.029 | 0.009 | 1.69 | 6.1 | 0.32 | 0.15 | 0.08 | | |
| 55 | 0.009 | 0.33 | 0.74 | 0.018 | 0.008 | 2.62 | 7.4 | 1.35 | 0.08 | | 0.05 | |
| 56 | 0.015 | 0.11 | 0.39 | 0.027 | 0.010 | 1.32 | 6.6 | 2.00 | 0.12 | | | 0.08 |
| 57 | 0.006 | 0.95 | 1.41 | 0.005 | 0.004 | 2.16 | 7.1 | 2.95 | | 0.07 | | 0.05 |
| 59 | 0.017 | 0.96 | 1.30 | 0.006 | 0.006 | 1.45 | 5.6 | 2.35 | | | 0.11 | 0.08 |
| 61 | 0.007 | 0.50 | 0.84 | 0.010 | 0.009 | 2.80 | 6.8 | 1.45 | | | 0.07 | |
| 65 | 0.011 | 0.25 | 0.81 | 0.006 | 0.010 | 2.85 | 7.1 | 0.93 | 0.08 | 0.05 | | |
| 67 | 0.005 | 0.23 | 0.37 | 0.019 | 0.006 | 1.13 | 9.3 | 0.59 | | | | 0.09 |
| 69 | 0.013 | 0.91 | 0.40 | 0.019 | 0.004 | 1.49 | 8.8 | 0.91 | 0.15 | 0.02 | 0.03 | |
| 71 | 0.006 | 0.83 | 0.27 | 0.027 | 0.004 | 1.01 | 7.5 | 1.78 | | 0.15 | | |
| 72 | 0.013 | 0.74 | 0.46 | 0.019 | 0.005 | 1.92 | 9.8 | 0.32 | | | | |

TABLE 6

| No. | Composition (Wt %) Ta | Hf | Cu | Mo | Sb | Ni | Ca | REM | N | X value ×10000 | Processability | Max. corrosion depth |
|---|---|---|---|---|---|---|---|---|---|---|---|---|
| | | | | | | INVENTION STEELS | | | | | | |
| 50 | | | | | | | | | 0.003 | 6.85 | ○ | ○ |
| 52 | | | | | | | | | 0.014 | 7.23 | ○ | ○ |
| 53 | 0.41 | | | | | | | | 0.017 | 1.02 | ○ | ○ |
| 54 | | | 1.21 | | | | | | 0.016 | 12.75 | ○ | ○ |
| 55 | | | | 1.78 | | | | | 0.005 | 10.08 | ○ | ○ |
| 56 | | | | | 0.31 | | | | 0.017 | 1.48 | ○ | ○ |
| 57 | | | 1.20 | 1.60 | | | | | 0.015 | 6.55 | ○ | ○ |
| 59 | | | 0.20 | | | | 0.06 | | 0.019 | 9.92 | ○ | ○ |
| 61 | | 0.17 | | 0.49 | 0.44 | | | | 0.010 | 13.71 | ○ | ○ |
| 65 | 0.07 | | | | 0.13 | | | 0.035 | 0.013 | 7.73 | ○ | ○ |
| 67 | 0.07 | 0.02 | 2.19 | 0.24 | | | | 0.011 | 0.004 | 8.94 | ○ | ○ |
| 69 | | 0.05 | 0.50 | 0.09 | 0.22 | | | 0.081 | 0.016 | 10.74 | ○ | ○ |
| 71 | | | | | | | | | 0.004 | 22.93 | ○ | ◎ |
| 72 | | 0.38 | | | | | | | 0.020 | 1.40 | ○ | ◎ |

(continued from Table 5, Part-1)

The X values in the Table are the value obtained by calculation from the following expression.

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

TABLE 7

| No. | Composition (Wt %) C | Si | Mn | P | S | Al | Cr | W | Nb | V | Ti | Zr |
|---|---|---|---|---|---|---|---|---|---|---|---|---|
| | | | | | INVENTION STEELS | | | | | | | |
| 75 | 0.020 | 0.41 | 0.17 | 0.029 | 0.005 | 2.78 | 8.1 | 1.07 | | 0.05 | 0.08 | |
| 77 | 0.005 | 0.69 | 1.35 | 0.030 | 0.010 | 1.35 | 7.5 | 1.13 | | | | |
| 78 | 0.004 | 0.06 | 1.46 | 0.030 | 0.004 | 1.92 | 8.3 | 0.90 | 0.04 | 0.03 | | 0.08 |
| 79 | 0.006 | 1.10 | 1.42 | 0.017 | 0.009 | 2.04 | 7.4 | 0.64 | 0.22 | 0.09 | | |
| 80 | 0.016 | 0.17 | 1.45 | 0.010 | 0.008 | 2.13 | 6.6 | 2.90 | | 0.12 | 0.07 | 0.02 |
| 81 | 0.013 | 0.12 | 0.74 | 0.024 | 0.009 | 1.68 | 7.8 | 0.20 | | 0.05 | 0.06 | |
| 82 | 0.011 | 0.14 | 0.84 | 0.027 | 0.007 | 1.91 | 8.3 | 2.43 | | | 0.04 | 0.05 |
| 83 | 0.013 | 0.67 | 0.88 | 0.023 | 0.003 | 2.78 | 7.7 | 0.53 | | | 0.08 | 0.07 |
| 84 | 0.008 | 0.36 | 1.14 | 0.023 | 0.010 | 1.73 | 8.3 | 2.38 | 0.11 | 0.03 | 0.03 | |
| 85 | 0.006 | 0.33 | 0.48 | 0.012 | 0.006 | 1.78 | 9.4 | 1.51 | 0.04 | 0.03 | 0.05 | 0.05 |
| 86 | 0.016 | 0.85 | 0.57 | 0.010 | 0.010 | 1.86 | 7.3 | 0.44 | 0.07 | 0.03 | 0.07 | 0.06 |
| | | | | | COMPARISON STEELS | | | | | | | |
| 87 | 0.007 | 0.45 | 1.39 | 0.015 | 0.006 | 0.05 | 2.3 | | | | 0.11 | |
| 88 | 0.004 | 0.99 | 0.36 | 0.025 | 0.009 | 0.17 | 7.3 | | 0.12 | | | |
| 89 | 0.005 | 0.74 | 1.31 | 0.005 | 0.008 | 0.07 | 7.5 | | | | | 0.16 |
| 90 | 0.019 | 0.63 | 1.43 | 0.026 | 0.009 | 0.08 | 9.3 | | | | | |
| 91 | 0.009 | 0.77 | 0.55 | 0.010 | 0.009 | 0.04 | 5.2 | | | | | |
| 92 | 0.007 | 0.48 | 0.59 | 0.011 | 0.008 | 0.11 | 9.8 | | | | | |
| 93 | 0.014 | 0.60 | 1.30 | 0.023 | 0.004 | 0.03 | 9.3 | | | | | |
| 94 | 0.019 | 0.15 | 0.16 | 0.013 | 0.005 | 0.04 | 8.6 | | | | 0.01 | |
| 95 | 0.014 | 0.96 | 1.38 | 0.027 | 0.004 | 0.03 | 9.2 | | | | | |
| 96 | 0.014 | 0.96 | 1.21 | 0.021 | 0.007 | 0.03 | 9.1 | | 0.02 | | | 0.01 |
| 97 | 0.008 | 1.04 | 0.89 | 0.026 | 0.005 | 0.03 | 11.5 | | | | 0.15 | |
| 98 | 0.013 | 0.49 | 0.40 | 0.015 | 0.004 | 0.11 | 12.1 | 0.15 | 0.15 | 0.05 | | |

(continued from Table 5, Part-2)

30

TABLE 8

| No. | Composition (Wt %) Ta | Hf | Cu | Mo | Sb | Ni | Ca | REM | N | X value ×10000 | Processability | Max. corrosion depth |
|---|---|---|---|---|---|---|---|---|---|---|---|---|
| | | | | | | INVENTION STEELS | | | | | | |
| 75 | | | | | | | | 0.010 | 0.014 | 5.24 | ○ | ◎ |
| 77 | 0.15 | 0.22 | | 0.47 | | | | 0.009 | 0.014 | 9.61 | ○ | ◎ |
| 78 | | | | | 0.08 | | 0.019 | | 0.007 | 12.36 | ○ | ◎ |
| 79 | | 0.07 | | | | 1.75 | 0.023 | | 0.020 | 29.62 | ○ | ◎ |
| 80 | | | | | | 1.22 | | 0.065 | 0.019 | 18.55 | ○ | ◎ |
| 81 | | 0.07 | 1.72 | 0.32 | 0.14 | | | | 0.011 | 11.16 | ○ | ◎ |
| 82 | 0.06 | | 1.37 | 1.28 | | 1.79 | | | 0.008 | 5.13 | ○ | ◎ |
| 83 | | 0.09 | 0.55 | 0.47 | | | 0.003 | | 0.010 | 14.57 | ○ | ◎ |
| 84 | 0.07 | | 2.97 | 1.35 | 0.21 | | 0.016 | | 0.013 | 15.12 | ○ | ◎ |
| 85 | 0.07 | | 1.44 | 0.20 | 0.39 | 1.63 | 0.010 | | 0.009 | 20.81 | ○ | ◎ |
| 86 | | 0.08 | 1.21 | 1.12 | 0.18 | 0.32 | | 0.039 | 0.016 | 19.21 | ○ | ◎ |
| | | | | | | COMPARISON STEELS | | | | | | |
| 87 | | | | | | | | | 0.012 | 11.45 | ○ | X |
| 88 | | | | | | | | | 0.014 | 2.02 | ○ | X |
| 89 | | | | | | | | | 0.019 | 3.50 | ○ | X |
| 90 | 0.02 | | | | | | | | 0.014 | −19.69 | X | X |
| 91 | | 0.02 | | | | | | 0.032 | 0.010 | −10.34 | X | X |
| 92 | | | | | | | 0.003 | | 0.020 | −15.79 | X | X |
| 93 | | | | 1.50 | | | | | 0.017 | −19.59 | X | X |
| 94 | | | | | 0.41 | | | | 0.008 | −15.18 | X | X |
| 95 | | | 1.10 | | | | | | 0.017 | −19.09 | X | X |
| 96 | | | | | | 1.80 | | | 0.05 | −9.23 | X | X |
| 97 | | 0.01 | 0.05 | | | | | | 0.06 | 22.67 | ○ | X |
| 98 | | | 0.40 | | | | | | 0.018 | 6.55 | ○ | X |

(continued from TABE 5, Part-3)

The X values in the Table are the valued obtained by calculation from the following exression.

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

We claim:

1. A steel excellent in corrosion resistance and processability which, in weight percent, consists of not less than 0.01% and less than 1.2% of Si,
0.1–1.5% of Mn,
5.5–9.9% of Cr and
1.0–3.0% of Al, has reduced contents of C of not more than 0.02%,
P of not more than 0.03%,
S of not more than 0.01% and
N of not more than 0.02%, further consists of one or more elements selected from among Nb, V, Ti, Zr, Ta and Hf in a total amount of 0.01–0.5%, and satisfies the relationship $$(Nb/93)+(V/51)+(Ti/48)+(Zr/91)+(Ta/181)+(Hf/179)-0.8\times[(C/12)+(N/14)]\geqq 0,$$

the remainder being Fe and unavoidable impurities.

2. A steel excellent in corrosion resistance and processability which, in weight percent, consists of not less than 0.01% and less than 1.2% of Si,
0.1–1.5% of Mn,
5.5–9.9% of Cr and
1.0–3.0% of Al, has reduced contents of C of not more than 0.02%,
P of not more than 0.03%,
S of not more than 0.01% and
N of not more than 0.02%, further consists of one or more elements selected from among Nb, V, Ti, Zr, Ta and Hf in a total amount of 0.01–0.5%, and satisfies the relationship $$(Nb/93)+(V/51)+(Ti/48)+(Zr/91)+(Ta/181)+(Hf/179)-0.8\times[(C/12)+(N/14)]\geqq 0, \text{ and}$$

as addition components further consists of, in weight percent, one or more of 0.05–3.0% of Cu,
0.05–2.0% of Mo,
0.01–0.5% of Sb,
0.01–2.0% of Ni, and
0.05–3.0% W, the remainder being Fe and unavoidable impurities.

3. A steel excellent in corrosion resistance and processability which, in weight percent, consists of not less than 0.01% and less than 1.2% of Si,
0.1–1.5% of Mn,
5.5–9.9% of Cr and
1.0–3.0% of Al, has reduced contents of C of not more than 0.02%,
P of not more than 0.03%,
S of not more than 0.01% and
N of not more than 0.02%, further consists of one or more elements selected from among Nb, V, Ti, Zr, Ta and Hf in a total amount of 0.01–0.5%, satisfies the relationship $$(Nb/93)+(V/51)+(Ti/48)+(Zr/91)+(Ta/181)+(Hf/179)-0.8\times[(C/12)+(N/14)]\geqq 0, \text{ and}$$

as addition components further consists of, in weight percent, one or more of 0.001–0.1% of rare earth elements, and
0.0005–0.03% of Ca, the remainder being Fe and unavoidable impurities.

4. A steel excellent in corrosion resistance and processability which, in weight percent, consists of not less than 0.01% and less than 1.2% of Si,
0.1–1.5% of Mn,
5.5–9.9% of Cr and
1.0–3.0% of Al, has reduced contents of C of not more than 0.02%,
P of not more than 0.03%,
S of not more than 0.01% and
N of not more than 0.02%, further consists of one or more elements selected from among Nb, V, Ti, Zr, Ta and Hf in a total amount of 0.01–0.5% satisfies the relationship $$(Nb/93)+(V/51)+(Ti/48)+(Zr/91)+(Ta/181)+(Hf/179)-0.8\times[(C/12)+(N/14)]\geqq 0,$$

as addition components further consists of, in weight percent, one or more of 0.05–3.0% of Cu,
0.05–2.0% of Mo,
0.01–0.5% of Sb,
0.01–2.0% of Ni, and
0.05–3.0% W, and as further addition components further consists of, in weight percent, one or more of 0.001–0.1% of rare earth elements, and
0.0005–0.03% of Ca, the remainder being Fe and unavoidable impurities.

5. An exhaust system for an internal combustion engine, said exhaust system comprising a steel according to claim 1.

6. An exhaust system for an internal combustion engine, said exhaust system comprising a steel according to claim 2.

7. An exhaust system for an internal combustion engine, said exhaust system comprising a steel according to claim 3.

8. An exhaust system for an internal combustion engine, said exhaust system comprising a steel according to claim 4.

* * * * *